US008061747B2

(12) United States Patent
Shoup et al.

(10) Patent No.: US 8,061,747 B2
(45) Date of Patent: Nov. 22, 2011

(54) SYSTEMS AND METHODS FOR LIFTING A VEHICLE

(75) Inventors: Jeffrey M. Shoup, Delmont, PA (US); Edward A. Timko, Jeanette, PA (US); L. Edgar Forsythe, Leechburg, PA (US); Gregory L. Peer, Delmont, PA (US)

(73) Assignee: Alcoa Inc., Pittsburgh, PA (US)

( * ) Notice: Subject to any disclaimer, the term of this patent is extended or adjusted under 35 U.S.C. 154(b) by 421 days.

(21) Appl. No.: 12/274,900

(22) Filed: Nov. 20, 2008

(65) Prior Publication Data

US 2010/0123324 A1 May 20, 2010

(51) Int. Cl.
*B66C 1/20* (2006.01)

(52) U.S. Cl. ..... 294/74; 294/904

(58) Field of Classification Search ..... 294/74, 294/68.1, 68.3, 67.4, 904; 296/35.3
See application file for complete search history.

(56) References Cited

U.S. PATENT DOCUMENTS

| | | | | |
|---|---|---|---|---|
| 1,941,582 | A * | 1/1934 | Schroeder | 294/82.1 |
| 3,021,166 | A | 2/1962 | Kempel et al. | |
| 3,718,361 | A * | 2/1973 | Marcotte | 294/67.4 |
| 3,863,973 | A * | 2/1975 | Ross | 294/74 |
| 3,892,321 | A * | 7/1975 | Westbrook, Jr. | 414/563 |
| 4,223,612 | A * | 9/1980 | Polley | 105/463.1 |
| 4,329,109 | A | 5/1982 | Bleyker | |
| 4,553,719 | A | 11/1985 | Ott | |
| 4,557,199 | A * | 12/1985 | Everett, Jr. | 105/362 |
| 5,169,197 | A | 12/1992 | Underbakke et al. | |
| 7,192,049 | B2 * | 3/2007 | Kuerten et al. | 280/727 |

FOREIGN PATENT DOCUMENTS

DE 102004026469 A1 12/2005

OTHER PUBLICATIONS

English language abstract of German Publication No. DE102004026469 (A1).

* cited by examiner

*Primary Examiner* — Dean Kramer

(74) *Attorney, Agent, or Firm* — Greenberg Traurig LLP

(57) ABSTRACT

One embodiment of the present invention relates to a system for lifting a vehicle. Another embodiment of the present invention relates to a method for lifting a vehicle. Another embodiment of the present invention relates to a structure with an integrated cable, strap, chain or the like for the purpose of vehicle lifting.

23 Claims, 10 Drawing Sheets

Cross-Vehicle Lifting Option

Fig. 7 Cross-Vehicle Lifting Option

Cross-Vehicle Lifting Option

Fig. 9 Sidewall Lifting Option

Sidewall Lifting Option

SYSTEMS AND METHODS FOR LIFTING A VEHICLE

FIELD OF THE INVENTION

One embodiment of the present invention relates to a system for lifting a vehicle.

Another embodiment of the present invention relates to a method for lifting a vehicle.

Another embodiment of the present invention relates to a structure with an integrated cable, strap, chain or the like for the purpose of vehicle lifting.

For the purposes of describing and claiming the present invention the term "vehicle" is intended to include (but not be limited to): a truck, an automobile, a military vehicle, a sport utility vehicle ("SUV"), or the like.

Further, for the purposes of describing and claiming the present invention the term "flexible load carrying material" is intended to include (but not be limited to): a cable, a sling, a chain or the like.

Further, for the purposes of describing and claiming the present invention the term "structural member" is intended to refer to a portion of a vehicle intended to be load-bearing (as opposed to, for example, an exterior sheet metal element that essentially does not serve a load-bearing function).

BACKGROUND OF THE INVENTION

Design of lifting provisions (e.g., for military vehicles) can present some difficult challenges. Vehicle structures in the vicinity of the lifting provisions must be strong enough and stiff enough to support the appropriate lifting loads while also providing attachment locations for the lifting provisions themselves.

Conventionally, lifting provisions are typically mounted (fastened or welded) on or near the top of the vehicle. Lifting of a vehicle using these discrete, isolated attachments typically imparts localized stresses on the vehicle structure (which often require substantial structural reinforcements). These lifting provisions and reinforcements are typically steel and may be large and very heavy.

To some degree, the weight of these lifting provisions and reinforcements raises the center of gravity of the vehicle. Of course, each increase in the height of the center of gravity also increases the likelihood of rollover during abrupt turns and/or lane changes.

Various patents related to lifting and hoisting include the following:

U.S. Pat. No. 3,021,166, entitled VEHICLE HOISTING ARRANGEMENT, which was issued Feb. 13, 1962 in the name of Kempel, et al.

U.S. Pat. No. 4,329,109, entitled VEHICLE LIFTING ATTACHMENT, which was issued May 11, 1982 in the name of Bleyker.

U.S. Pat. No. 4,553,719, entitled VEHICLE LIFTING SYSTEM AND METHOD, which was issued Nov. 19, 1985 in the name of Ott.

U.S. Pat. No. 5,169,197, entitled LIFT LINK FOR HELICOPTER EXTERNAL LIFT OF DUAL HMMWV'S, which was issued Dec. 8, 1992 in the name of Underbakke, et al.

DE102004026469, entitled BODY, ESPECIALLY FOR MOTOR VEHICLE HAS HOLLOW SUPPORTS WITH RECLOSABLE OPENINGS TOWARDS FLOOR OF VEHICLE FOR ACCOMMODATING JACK'S SUPPORTING ARM OF A JACK, AT LEAST ONE RECLOSABLE OPENING TOWARDS FLOOR OF VEHICLE, published Dec. 15, 2005, in the name of Klink Achim et al.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components (and any size, material and similar details shown in the figures are, of course, intended to be illustrative and not restrictive). Therefore, specific structural and functional details disclosed herein are not to be interpreted as limiting, but merely as a representative basis for teaching one skilled in the art to variously employ the present invention.

Various embodiments of the present invention provide a mechanism for distributing lifting loads over a larger portion of the vehicle structure (as compared, for example, to conventional discrete lifting points) by utilizing a "sling" type lift.

In one example, a flexible load carrying material may be inserted through a structural member of the vehicle.

In another example, a plurality of flexible load carrying materials may be inserted through a plurality of structural members of the vehicle (e.g., one flexible load carrying material through each of the structural members).

In another example, a flexible load carrying material may be inserted outside (e.g., below and/or adjacent to) a structural member of the vehicle.

In another example, a plurality of flexible load carrying materials may be inserted outside (e.g., below and/or adjacent to) a plurality of structural members of the vehicle (e.g., one flexible load carrying material outside each of the structural members).

In one specific example, the structural member(s) containing or supporting the flexible load carrying material(s) may be positioned low and wide on the vehicle. (e.g., positioning for a cross-car sling-type lift).

In another specific example, the lifting loads may be distributed among structural members comprising the side walls of the vehicle (e.g., the flexible load carrying material may be along or within two of the pillars (A, B, C or D) of the vehicle and within or below a lower sidewall structural member or component).

Figure 1:
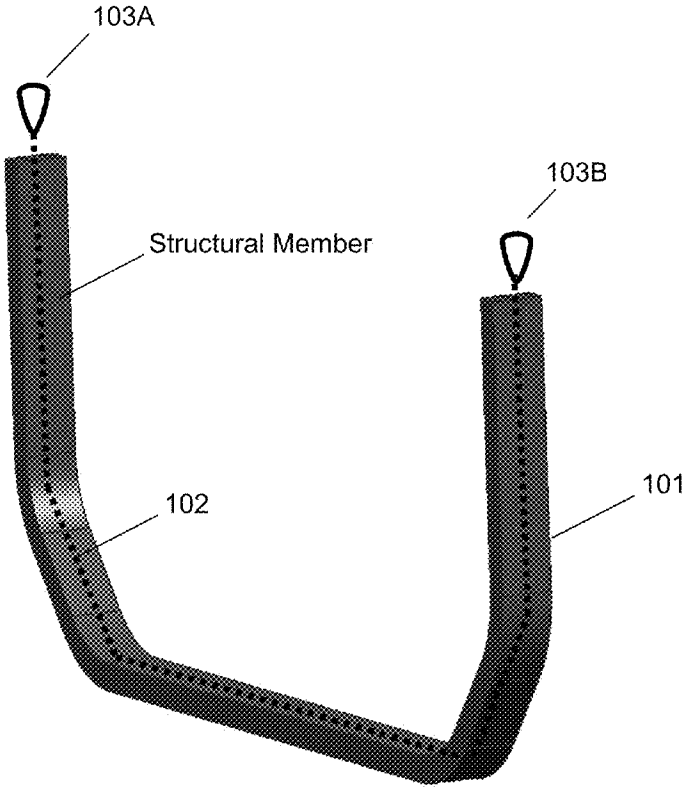
FIG. 1 is a perspective view showing an example vehicle structural member having disposed therein a flexible load carrying material according to an embodiment of the present invention.

Referring now to FIG. 1, a perspective view showing an example vehicle structural member 101 having disposed therein a flexible load carrying material 102 according to an embodiment of the present invention is shown (flexible load carrying material 102 is shown in this Fig. as a dotted line inside of structural member 101). In one example, structural member 101 may be a cross-vehicle structural member. In another example, hooks, loops, shackles, connectors or the like 103A, 103B may be provided at the ends of flexible load carrying material 102 (e.g., for attachment to a crane, hoist, or other lifting mechanism).

Figure 2:
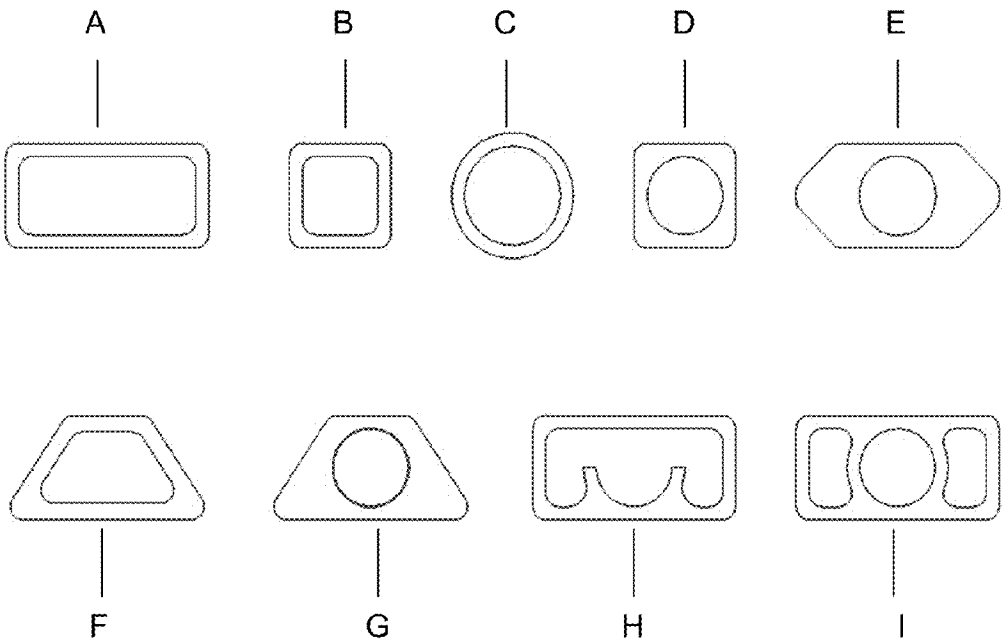
FIG. 2 shows views of various cross-sections of vehicle structural members according to various examples (called-out as A-I) of the present invention.

Referring now to FIG. 2, views showing various cross-sections of vehicle structural members A-I according to various examples of the present invention are shown (in these examples, the cross-sections are perpendicular to a long axis of each vehicle structural member A-I).

Figure 3:
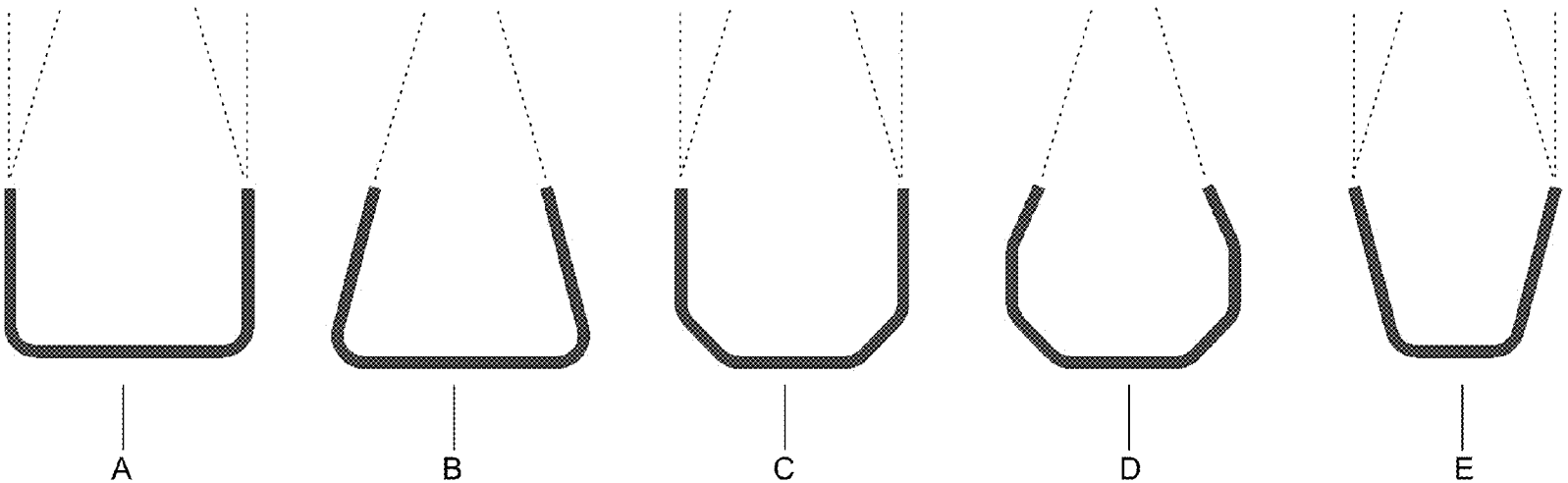
FIG. 3 shows views of various shapes of vehicle structural members according to various examples (called-out as A-E) of the present invention.

Referring now to FIG. 3, views showing various shapes of vehicle structural members A-E according to various examples of the present invention are shown (in these examples, the views are of each vehicle structural member A-E in a cross-vehicle position). Of note, the dotted lines above each structural member in these views depict schematic diagrams of attachment to a crane, hoist, or other lifting mechanism. Of further note, the configuration of A, C and E (for example) may be used with a spreader bar.

Figure 4:
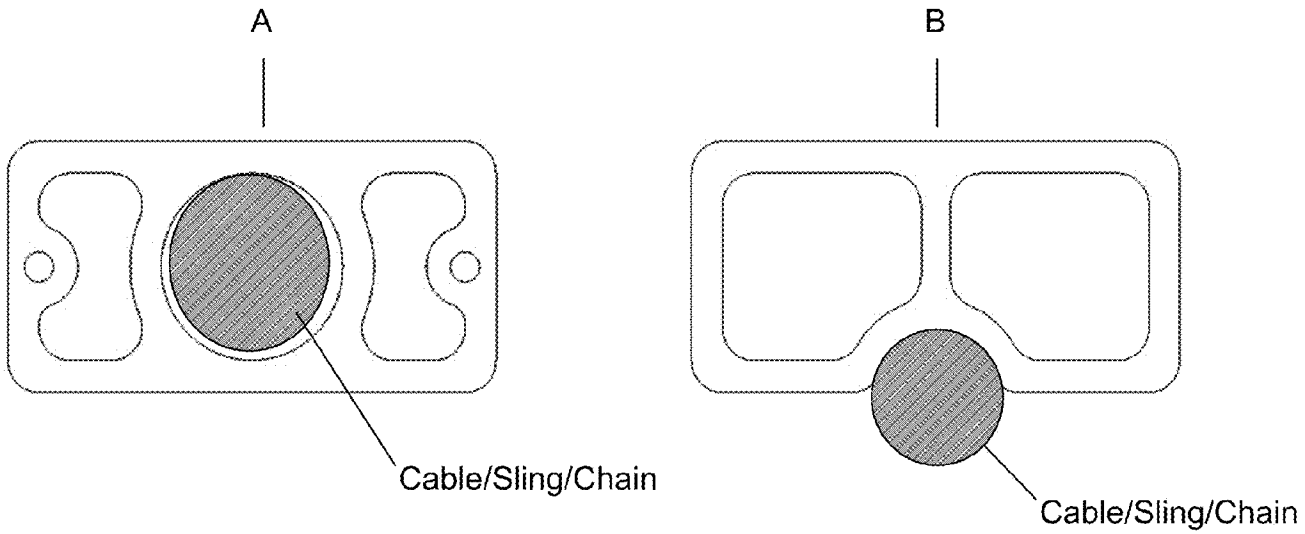
FIG. 4 shows views of placement of a flexible load carrying material in connection with various cross-sections of vehicle structural members according to various examples (called-out as A and B) of the present invention.

Referring now to FIG. 4, views showing placement of a flexible load carrying material in connection with various cross-sections of vehicle structural members A and B according to various examples of the present invention are shown (in these examples, the cross-sections are perpendicular to a long axis of each vehicle structural member A and B; in addition, in these examples, vehicle structural member A is shown with a passage with an essentially circular cross section for receiving a flexible load carrying material with an essentially circular cross section; further, in these examples, vehicle structural member B is shown with a valley with an essentially semi-circular cross section for receiving a flexible load carrying material with an essentially circular cross section).

Figure 5:
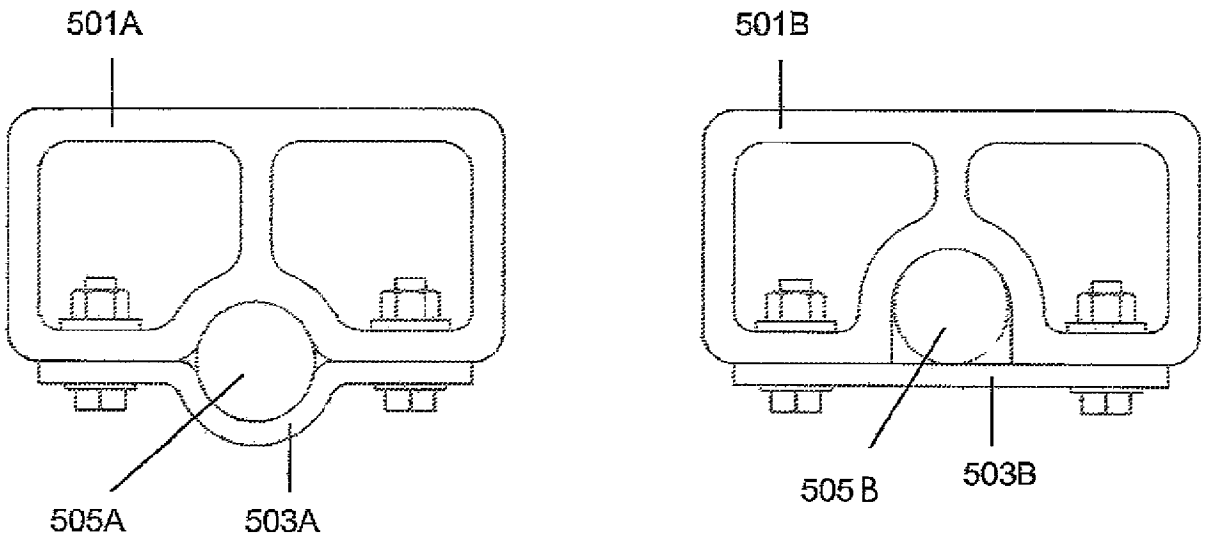
FIG. 5 shows views of other embodiments of the present invention in which a cover is disposed over a vehicle structural member, with a flexible load carrying material disposed in between (these views are cross-sections of two example vehicle structural members).

Referring now to FIG. 5, views of other embodiments of the present invention in which a cover plate or the like 503A, 503B is disposed over a vehicle structural member 501A, 501B, with a flexible load carrying material 505A,505B disposed in between (these views are cross-sections of vehicle structural members 501A,501B).

Figure 6:
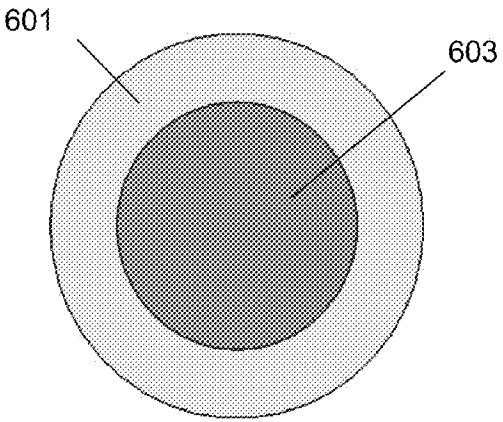
FIG. 6 is a cross-section view of a protective sheath around a flexible load carrying material (in this case a cable) according to an embodiment of the present invention.

Referring now to FIG. 6, a cross-section view of a protective sheath 601 around a flexible load carrying material 603 (in this example a cable) according to an embodiment of the present invention is shown. The sheath 601 may be formed from any appropriate material (e.g., plastic rubber, polymer). The sheath 601 may be a cover or a coating. The sheath 601 may eliminate or reduce damage (e.g., due to rubbing or friction) to the flexible load carrying material 603 and/or to a structural member.

Figure 7:
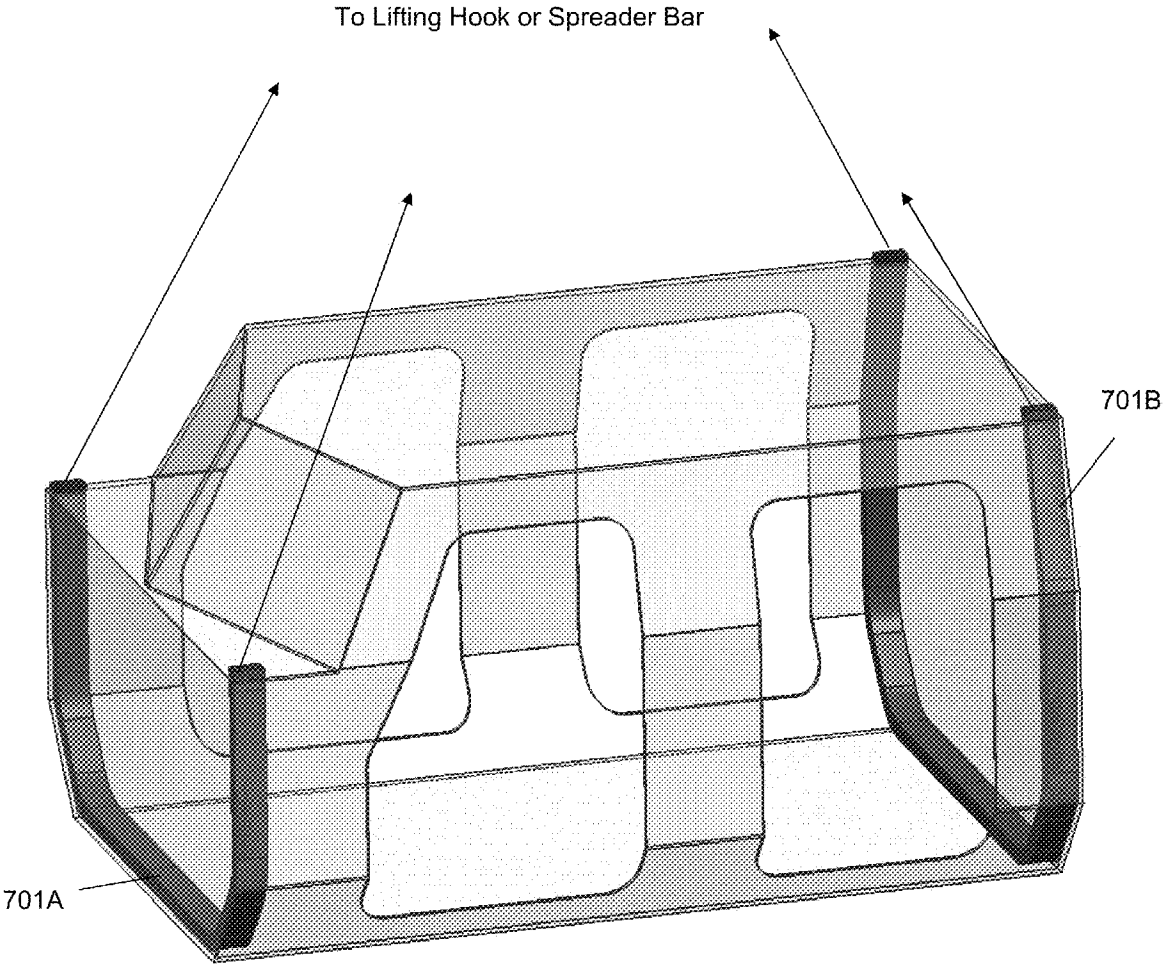
FIG. 7 is a perspective view showing a portion of a vehicle in phantom and vehicle structural members (in a cross vehicle lifting configuration) according to an embodiment of the present invention.

Referring now to FIG. 7, a perspective view showing a portion of a vehicle in phantom and vehicle structural members (in a cross vehicle lifting configuration) according to an embodiment of the present invention is shown. In this example, vehicle structural members 701A,701B may have disposed therein flexible load carrying material.

Figure 8:
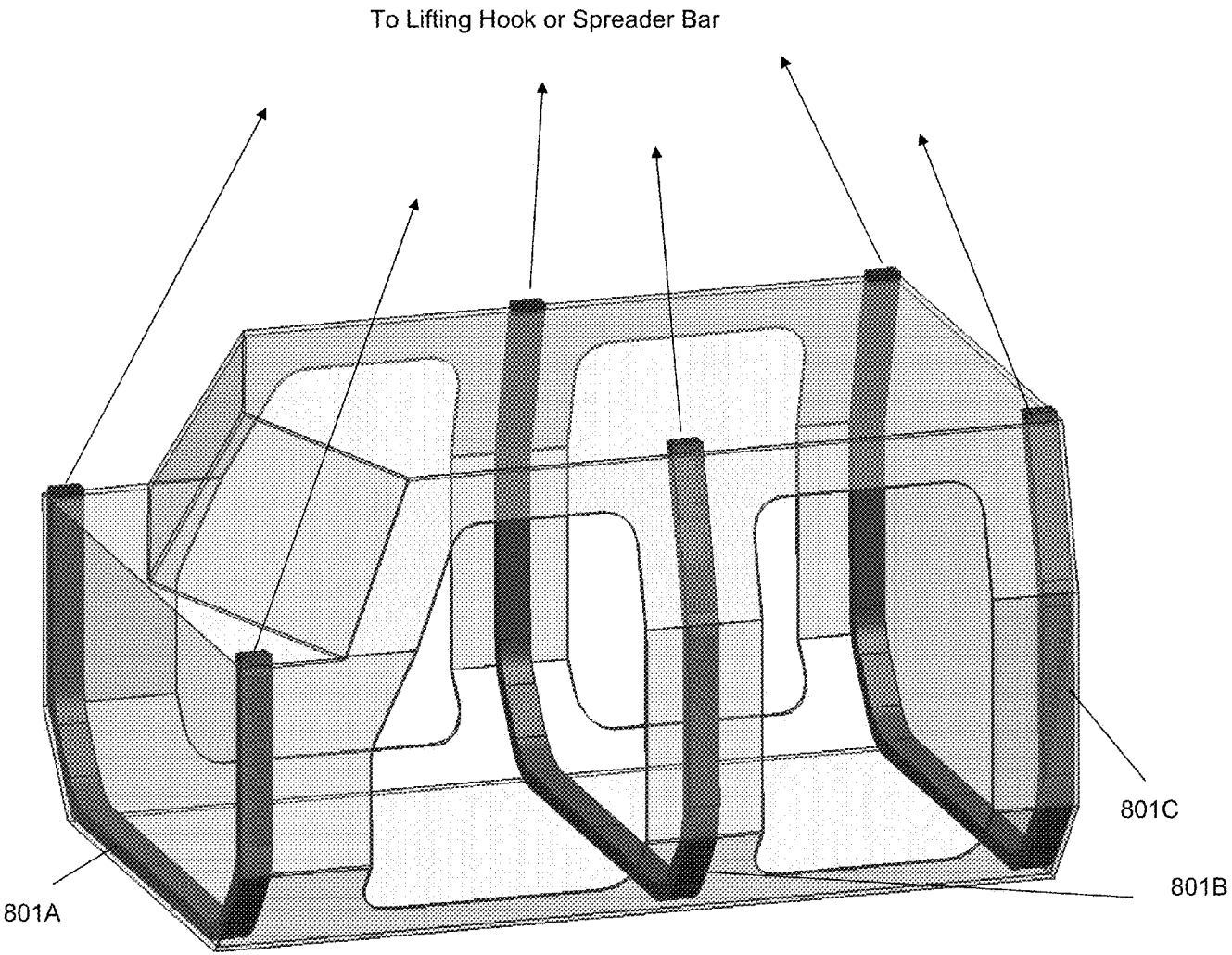
FIG. 8 is a perspective view showing a portion of a vehicle in phantom and vehicle structural members (in a cross vehicle lifting configuration) according to an embodiment of the present invention.

Referring now to FIG. 8, a perspective view showing a portion of a vehicle in phantom and vehicle structural members (in a cross vehicle lifting configuration) according to an embodiment of the present invention is shown. In this example, vehicle structural members 801A,801B,801C may have disposed therein flexible load carrying material.

Figure 9:
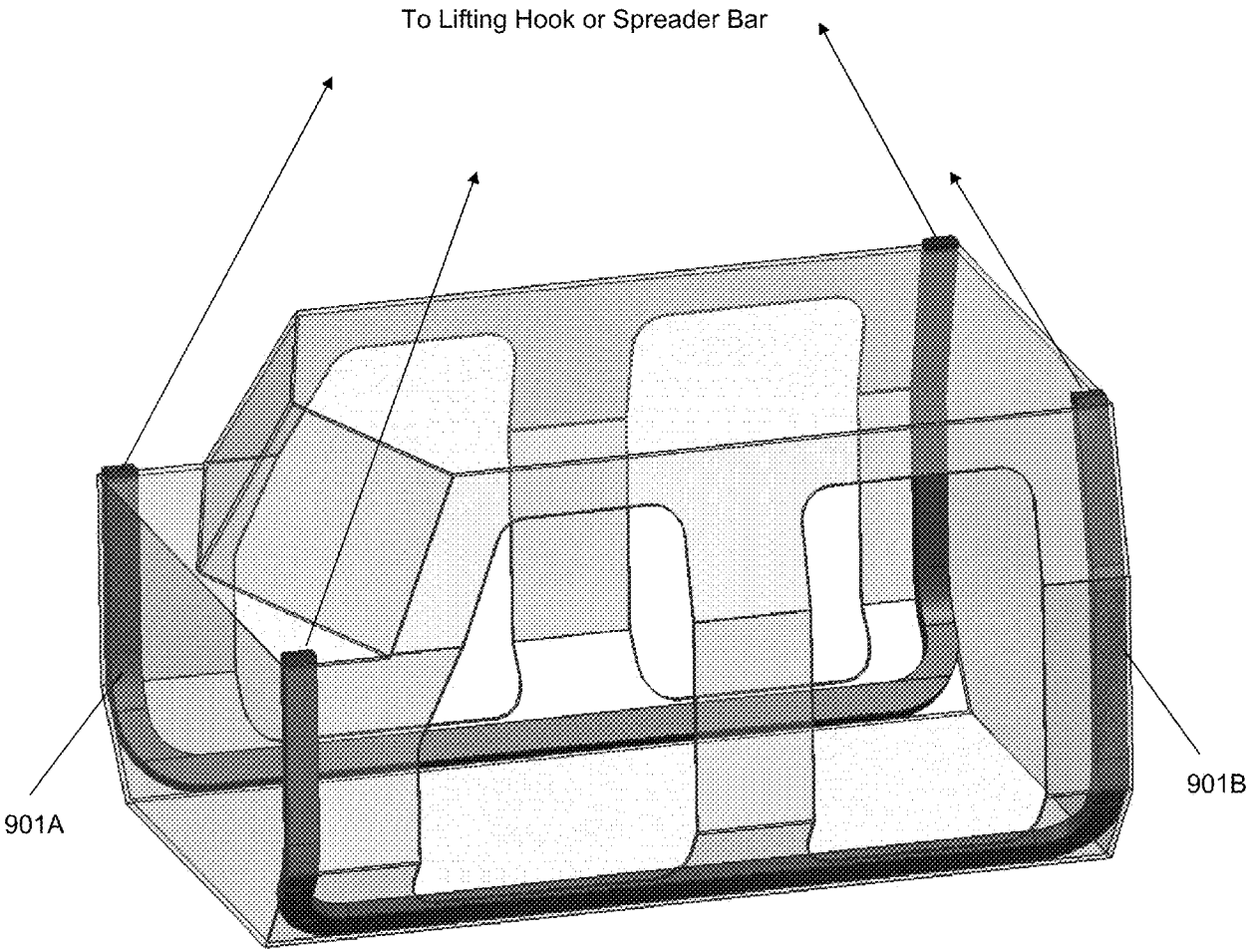
FIG. 9 is a perspective view showing a portion of a vehicle in phantom and vehicle structural members (in a sidewall lifting configuration) according to an embodiment of the present invention.

Referring now to FIG. 9, a perspective view showing a portion of a vehicle in phantom and vehicle structural members (in a sidewall lifting configuration) according to an embodiment of the present invention is shown. In this example, vehicle structural members 901A,901B may have disposed therein flexible load carrying material.

Figure 10:
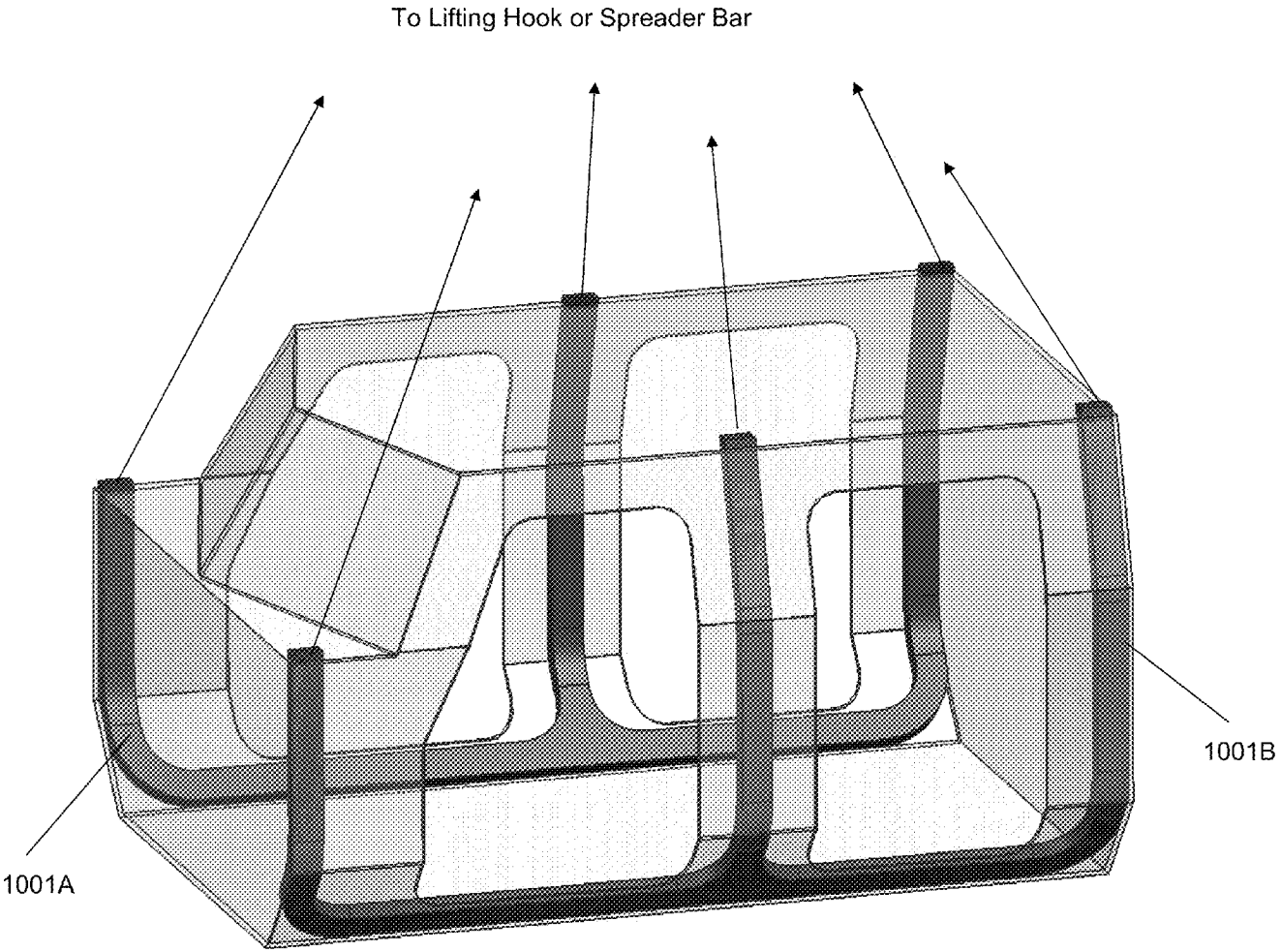
FIG. 10 is a perspective view showing a portion of a vehicle in phantom and vehicle structural members (in a sidewall lifting configuration) according to an embodiment of the present invention.

Referring now to FIG. 10, a perspective view showing a portion of a vehicle in phantom and vehicle structural members (in a sidewall lifting configuration) according to an embodiment of the present invention is shown. In this example, vehicle structural members 1001A,1001B may have disposed therein flexible load carrying material.

In one embodiment of the present invention, a system for lifting a vehicle, wherein the vehicle has at least one structural member is provided, comprising: at least one flexible load carrying material having a first end and a second end; wherein at least a portion of the flexible load carrying material is disposed within at least a portion of the structural member; and wherein the first end and the second end of the flexible load carrying material are exposed to the outside of the structural member (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In one example, the vehicle may be selected from the group including (but not limited to): a truck, an automobile, a military vehicle, an SUV.

In another example, the flexible load carrying material may be selected from the group including (but not limited to): a cable, a sling, a chain.

In another example, the flexible load carrying material may be disposed essentially fully within the structural member, with the exception that the first end and the second end of the flexible load carrying material are outside of the structural member (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In another example, the flexible load carrying material may be disposed essentially fully within the structural member, with the first end and the second end of the flexible load carrying material being inside of the structural member and the first end and the second end of the flexible load carrying material being exposed to the outside of the structural member (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In another example, the vehicle may have a plurality of structural members; wherein at least a first flexible load carrying material may be disposed at least partially within a first one of the structural members; and wherein at least a second flexible load carrying material may be disposed at least partially within a second one of the structural members. In one example, the first end and the second end of each flexible load carrying material may be exposed to the outside of each structural member such as to allow each first end and second end of each flexible load carrying material to be attached to a crane, hoist, or other lifting mechanism to lift the vehicle; in another example, the attachment may be directly; in another example, the attachment may be via use of one or more hooks, loops, shackles, connectors or the like).

In another example, the structural member may run across a width of the vehicle.

In another example, the first structural member may run across a width of the vehicle and the second structural member may run across the width of the vehicle.

In another example, the first structural member may run across the width of the vehicle at a location adjacent a front of the vehicle and the second structural member may run across the width of the vehicle at a location adjacent a rear of the vehicle.

In another example, the structural member may run across a length of the vehicle.

In another example, the first structural member may run across a length of the vehicle and the second structural member may run across the length of the vehicle.

In another example, the first structural member may run across a length of the vehicle at a first side of the vehicle and the second structural member may run across the length of the vehicle at a second side of the vehicle.

In another embodiment of the present invention a system for lifting a vehicle, wherein the vehicle has at least one structural member may be provided, comprising: at least one flexible load carrying material having a first end and a second end; at least one cover element; wherein at least a portion of the flexible load carrying material is disposed adjacent at least a portion of the structural member; wherein the cover element at least partially covers the structural member such that the flexible load carrying material is between at least a portion of the cover element and at least a portion of the structural member; and wherein the first end and the second end of the flexible load carrying material are exposed outside of the structural member and the cover element (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In one example, the vehicle may be selected from the group including (but not limited to): a truck, an automobile, a military vehicle, an SUV.

In another example, the flexible load carrying material may be selected from the group including (but not limited to): a cable, a sling, a chain.

In another example, the flexible load carrying material may be disposed essentially fully between the structural member and the cover element, with the exception that the first end and the second end of the flexible load carrying material are outside of the structural member and the cover element (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In another example, the flexible load carrying material may be disposed essentially fully between the structural member and the cover element, with the first end and the second end of the flexible load carrying material being inside of the structural member and the cover element and the first end and the second end of the flexible load carrying material being exposed to the outside of the structural member and the cover element (e.g., to allow the first end and the second end of the flexible load carrying material to be attached to a crane, hoist, or other lifting mechanism to lift the vehicle; in one example, the attachment may be directly; in another example, the attachment may be via use of one or more hooks, loops, shackles, connectors or the like).

In another example, the vehicle may have a plurality of structural members; wherein a first flexible load carrying material may be disposed at least partially between a first one of the structural members and a first cover element; and wherein a second flexible load carrying material may be disposed at least partially between a second one of the structural members and a second cover element. In one example, the first end and the second end of each flexible load carrying material may be exposed to the outside of the respective structural member and cover member such as to allow each first end and second end of each flexible load carrying material to be attached to a crane, hoist, or other lifting mechanism to lift the vehicle; in another example, the attachment may be directly; in another example, the attachment may be via use of one or more hooks, loops, shackles, connectors or the like).

In another example, the structural member may run across a width of the vehicle.

In another example, the first structural member may run across a width of the vehicle and the second structural member may run across the width of the vehicle.

In another example, the first structural member may run across the width of the vehicle at a location adjacent a front of the vehicle and the second structural member may run across the width of the vehicle at a location adjacent a rear of the vehicle.

In another example, the structural member may run across a length of the vehicle.

In another example, the first structural member may run across a length of the vehicle and the second structural member may run across the length of the vehicle.

In another example, the first structural member may run across a length of the vehicle at a first side of the vehicle and the second structural member may run across the length of the vehicle at a second side of the vehicle.

As described herein, various embodiments of the present invention may provide for distributing load throughout a larger portion of the vehicle structure (as compared, for example, to conventional discrete lifting points).

Further, as described herein, various embodiments of the present invention may provide for reduction or elimination of isolated "point loading" conditions (that is, reduce or eliminate conventional stress concentrations).

Further, as described herein, various embodiments of the present invention may provide for uniform support.

Further, as described herein, various embodiments of the present invention may provide for potential reduction in vehicle mass (as compared, for example, to conventional discrete lifting points).

Further, as described herein, various embodiments of the present invention may provide for potential reduction in height of the vehicle center of gravity (as compared, for example, to conventional discrete lifting points).

Further, as described herein, various embodiments of the present invention may provide a variety of configuration options including (but not limited to): 1) one or more flexible load carrying materials contained within one or more hollow extrusions; 2) one or more flexible load carrying materials mounted to and/or positioned outside and/or below structural components or members; 3) various extruded profile options for structural members.

If note, the capacity of the flexible load carrying material(s) utilized should, of course, take into account the gross vehicle weight ("GVW") of the vehicle being lifted. In this regard, to the extent that relatively lightweight (or low capacity) flexible load carrying material(s) are utilized, such relatively lightweight flexible load carrying material(s) should be used with a relatively lower GVW vehicle. Conversely, to the extent that relatively heavyweight (or high capacity) flexible load carrying material(s) are utilized, such relatively heavyweight flexible load carrying material(s) may be used with a relatively higher GVW vehicle.

In another example, more than two structural members/flexible load carrying materials may be utilized.

In another example, a first structural member/flexible load carrying material may run across a width of the vehicle, a second structural member/flexible load carrying material may run across the width of the vehicle and a third structural member/flexible load carrying material may run across the width of the vehicle (of course, any desired number of structural member(s) and flexible load carrying material(s) may be utilized).

In another example, a first structural member/flexible load carrying material may run across a width of the vehicle at a location adjacent a front of the vehicle, a second structural member/flexible load carrying material may run across the width of the vehicle at a location adjacent a rear of the vehicle and one or more additional structural members/flexible load carrying materials may run across the width of the vehicle at location(s) between the first structural member/flexible load carrying material and the second structural member/flexible load carrying material.

In another example, various methods corresponding to the various systems described herein may be utilized. For example, a method of lifting a vehicle corresponding to a system for lifting a vehicle described herein may be utilized. Further, a method for constructing a system for lifting a vehicle described herein may be utilized.

In another example, end cap(s) may be provided at one or more open ends of the structural member(s). In one specific example, end cap(s) may be spring-loaded. In another specific example, each end of a flexible load carrying material may pass through (e.g., freely pass through) each respective end cap. In another specific example, each end of a flexible load carrying material may pass through each respective end cap, wherein the interface between each end cap and the flexible load carrying material may be sealed by a bellows, flexible coupling or the like.

In another example, the system may be serviceable (e.g., end cap(s) may be removable to allow for replacement of (and/or maintenance to) the flexible load carrying material (s)).

As described herein, in a cross vehicle lifting configuration, the flexible load carrying material may be contained within and/or adjacent to the structural member(s) such that each of the first end and the second end of the flexible load carrying material is on a different side of the vehicle.

Further, as described herein, in a sidewall lifting configuration, the flexible load carrying material may be contained within and/or adjacent to the sidewall structural member(s) such that both the first end and the second end of the flexible load carrying material are on the same side of the vehicle.

While a number of embodiments of the present invention have been described, it is understood that these embodiments are illustrative only, and not restrictive, and that many modifications may become apparent to those of ordinary skill in the art. For example, any component described herein may be provided in any desired size. Further, any components described herein may be combined with any other components described herein. Further still, each flexible load carrying material may be passed through a totally hollow structural member or a partially hollow structural member. Further still, various embodiments of the present invention may be applied to a JEEP, a HUMVEE and/or a military vehicle. Further still, a cross vehicle lifting configuration may be used, a sidewall lifting configuration may be used or a combined cross vehicle lifting configuration and a sidewall lifting configuration may be used. Further still, any steps described herein may be carried out in any desired order (and any additional steps may be added as desired and/or any steps may be deleted as desired).

What is claimed is:

1. A system for lifting a vehicle, wherein the vehicle has at least one structural member, comprising:

at least one flexible load carrying material having a first end and a second end;

wherein at least a portion of the flexible load carrying material is disposed within at least a portion of the structural member; and wherein the first end and the second end of the flexible load carrying material are exposed to the outside of the structural member;

wherein the flexible load carrying material is disposed essentially fully within the structural member, with the first end and the second end of the flexible load carrying material being inside of the structural member and the first end and the second end of the flexible load carrying material being exposed to the outside of the structural member.

2. The system of claim 1, wherein the vehicle selected from the group consisting of: a truck, an automobile, a military vehicle, an SUV.

3. The system of claim 1, wherein the flexible load carrying material is selected from the group consisting of: a cable, a sling, a chain.

4. The system of claim 1, wherein the flexible load carrying material is disposed essentially fully within the structural member, with the exception that the first end and the second end of the flexible load carrying material are outside of the structural member.

5. The system of claim 1, wherein the structural member runs across a width of the vehicle.

6. The system of claim 1, wherein the structural member runs across a length of the vehicle.

7. A system for lifting a vehicle, wherein the vehicle has a plurality of structural members; wherein each structural member comprises:

at least a first flexible load carrying material having a first end and a second end, wherein the first flexible load carrying material is disposed at least partially within a first one of the structural members;

wherein the first end and the second end of the first flexible load carrying material are exposed to the outside of the structural member; and wherein at least a second flexible load carrying material having a first end and a second end, is disposed at least partially within a second one of the structural member wherein the first end and the second end of the second flexible load carrying material are exposed to the outside of the structural member.

8. The system of claim 7, wherein the first structural member runs across a width of the vehicle and wherein the second structural member runs across the width of the vehicle.

9. The system of claim 8, wherein the first structural member runs across a width of the vehicle at a location adjacent a front of the vehicle and wherein the second structural member runs across the width of the vehicle at a location adjacent a rear of the vehicle.

10. The system of claim 7, wherein the first structural member runs across a length of the vehicle and wherein the second structural member runs across the length of the vehicle.

11. The system of claim 10, wherein the first structural member runs across a length of the vehicle at a first side of the vehicle and wherein the second structural member runs across the length of the vehicle at a second side of the vehicle.

12. A system for lifting a vehicle, wherein the vehicle has at least one structural member, comprising:

at least one flexible load carrying material having a first end and a second end;

at least one cover element;

wherein at least a portion of the flexible load carrying material is disposed adjacent at least a portion of the structural member;

wherein the cover element at least partially covers the structural member such that the flexible load carrying material is between at least a portion of the cover element and at least a portion of the structural member; and wherein the first end and the second end of the flexible load carrying material are exposed outside of the structural member and the cover element.

13. The system of claim 12, wherein the vehicle selected from the group consisting of: a truck, an automobile, a military vehicle, an SUV.

14. The system of claim 12, wherein the flexible load carrying material is selected from the group consisting of: a cable, a sling, a chain.

15. The system of claim 12, wherein the flexible load carrying material is disposed essentially fully between the structural member and the cover element, with the exception that the first end and the second end of the flexible load carrying material are outside of the structural member and the cover element.

16. The system of claim 12, wherein the flexible load carrying material is disposed essentially fully between the structural member and the cover element, with the first end and the second end of the flexible load carrying material being inside of the structural member and the cover element and the first end and the second end of the flexible load carrying material being exposed to the outside of the structural member and the cover element.

17. The system of claim 12, wherein: the vehicle has a plurality of structural members;

wherein a first flexible load carrying material is disposed at least partially between a first one of the structural members and a first cover element; and wherein a second flexible load carrying material is disposed at least partially between a second one of the structural members and a second cover element.

18. The system of claim 17, wherein the first structural member runs across a width of the vehicle and wherein the second structural member runs across the width of the vehicle.

19. The system of claim 18, wherein the first structural member runs across a width of the vehicle at a location adjacent a front of the vehicle and wherein the second structural member runs across the width of the vehicle at a location adjacent a rear of the vehicle.

20. The system of claim 17, wherein the first structural member runs across a length of the vehicle and wherein the second structural member runs across the length of the vehicle.

21. The system of claim 20, wherein the first structural member runs across a length of the vehicle at a first side of the vehicle and wherein the second structural member runs across the length of the vehicle at a second side of the vehicle.

22. The system of claim 12, wherein the structural member runs across a width of the vehicle.

23. The system of claim 12, wherein the structural member runs across a length of the vehicle.

* * * * *